US006264252B1

(12) United States Patent
Clancy

(10) Patent No.: US 6,264,252 B1
(45) **Date of Patent: *Jul. 24, 2001**

(54) MULTI-POINT SLIDING DOOR LATCH

(76) Inventor: John M. Clancy, 931 W. Elmwood, Clawson, MI (US) 48017

( * ) Notice: Subject to any disclaimer, the term of this patent is extended or adjusted under 35 U.S.C. 154(b) by 0 days.

This patent is subject to a terminal disclaimer.

(21) Appl. No.: 09/170,178

(22) Filed: Oct. 13, 1998

Related U.S. Application Data

(63) Continuation of application No. 08/786,667, filed on Jan. 21, 1997, now Pat. No. 5,820,170.

(51) Int. Cl.[7] ..... E05C 9/00
(52) U.S. Cl. ..... 292/196; 292/123; 292/97
(58) Field of Search ..... 292/29, 123, 97, 292/196; 297/DIG. 46, 25, 96, 121, 24, 3; 70/95, 99

(56) References Cited

U.S. PATENT DOCUMENTS

| | | | | |
|---|---|---|---|---|
| 1,716,113 | | 6/1929 | Carlson | 292/26 |
| 3,162,472 | | 12/1964 | Rust | 292/DIG. 46 |
| 3,413,025 | * | 11/1968 | Sperry | 292/26 |
| 3,899,201 | * | 8/1975 | Paioletti | 292/25 |
| 3,904,229 | * | 9/1975 | Waldo | 292/29 |
| 4,643,005 | * | 2/1987 | Logas | 70/95 |
| 4,973,091 | | 11/1990 | Paulson | 292/DIG. 46 |
| 5,125,703 | | 6/1992 | Clancy et al. | 292/337 |

OTHER PUBLICATIONS

"Window Executive" Catalog, Summer 1996 issue, vol. 2, Issue 6, pp. 9–10.
W & F Mfg., Inc., Multi–Point Latch, 1 pg.

* cited by examiner

*Primary Examiner*—Lynne H. Browne
*Assistant Examiner*—Fredrick Conley
(74) *Attorney, Agent, or Firm*—Young & Basile, P.C.

(57) ABSTRACT

A multi-point sliding door latch adapted to be fitted in a single opening in the lock face of the stile of the sliding door and arranged for coaction with a keeper structure on an associated jamb and for coaction with a handle assembly mounted on the stile of the sliding door and including a tail member operated by a thumb turn or a key lock. The latch includes a unitary hollow housing sized to fit in the stile opening, a pair of vertically spaced upper and lower hooks each pivotally mounted in the housing for movement between a retracted unlatched position within the hollow of the housing and an extended latch position extending out of the hollow of the housing for latching coaction with the keeper structure; upper and lower pivot arms pivotally mounted in the housing in vertically spaced side-by-side relation between the upper and lower hooks and each adapted to receive a tail member of the handle assembly; a gang link connecting the upper and lower pivot arms so that pivotal movement of one pivot arm generates corresponding pivotal movement of the other pivot arm; an upper link interconnecting the upper pivot arm and the upper hook; and a lower link interconnecting the lower pivot arm and the lower hook.

14 Claims, 6 Drawing Sheets

FIG-1
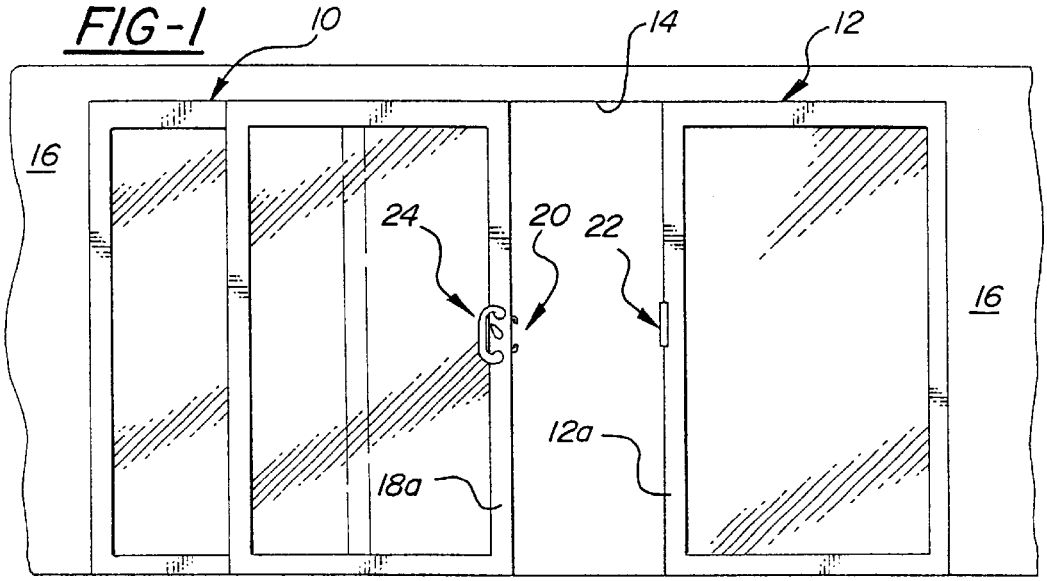
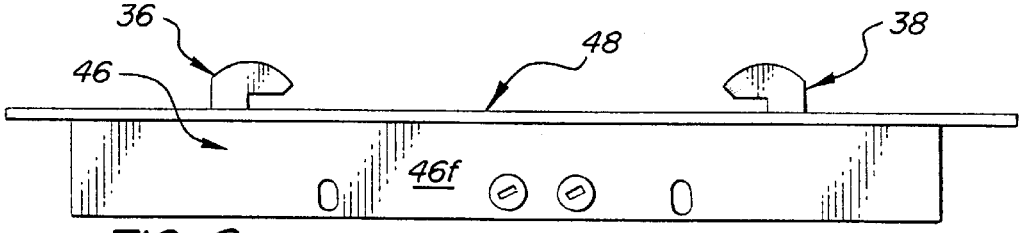
FIG-2
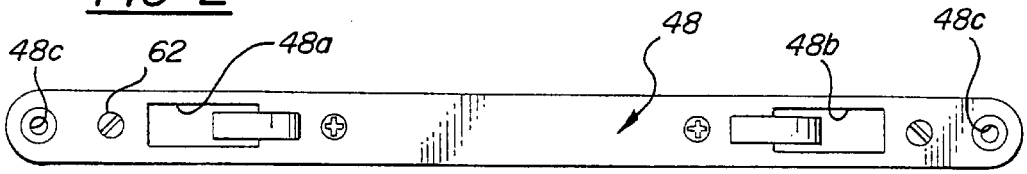
FIG-3
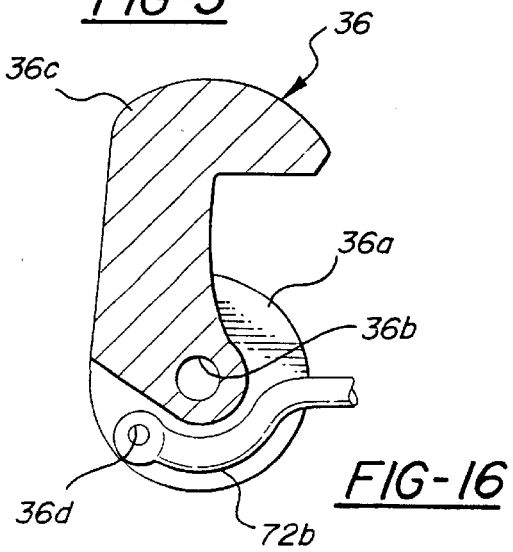
FIG-16
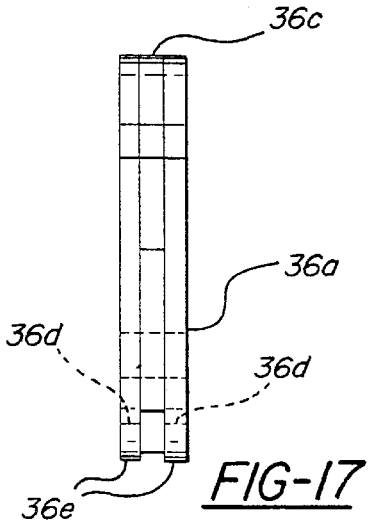
FIG-17

MULTI-POINT SLIDING DOOR LATCH

RELATED APPLICATION

This application is a continuation of U.S. patent application Ser. No. 08/786,667 filed Jan. 21, 1997, now U.S. Pat. No. 5,820,170.

BACKGROUND OF THE INVENTION

This invention relates to multi-point door latches and more particularly to a multi-point door latch especially suitable for use with sliding doors.

In a typical sliding patio door installation, the door is maintained in a latched and/or locked condition by a latch mounted in the lock face of the stile of the sliding door and having a single hook or other latching element coacting with a keeper structure on the associated door jamb. Whereas these so called single point constructions are satisfactory for most installations, there is increasing need and demand for more security with respect to sliding patio doors to preclude forced entry. In an effort to increase the latch security, so-called multi-point latches have been developed and utilized in which more than one latching element engages the keeper structure of the jam to provide a more secure latching arrangement and provide more security against forced entry. Whereas these multi-point latch structure do increase the strength of the latch and thereby guard against forced entry, they tend to be very complicated and expensive and further, are difficult to install since they require substantial modification of the stile of the sliding door to accommodate the latch.

SUMMARY OF THE INVENTION

This invention is directed to the provision of an improved sliding door multi-point latch.

More specifically, this invention is directed to the provision of a sliding door multi-point latch that is simple, inexpensive and requires minimal modification of the existing door structure.

The invention latch is adapted to be fitted in a single opening in the lock face of the stile of the door and is arranged for coaction with a keeper structure on an associated jamb and for coaction with a handle assembly mounted on the stile of the door and including a tail member operated by a thumb turn or a key lock.

The invention latch includes a unitary hollow housing sized to fit in the single stile opening; a pair of vertically spaced upper and lower hooks each mounted in the housing for movement between a retracted unlatched position within the hollow of the housing and an extended latched position extending out of the hollow of the housing for latching coaction with the keeper structure; and actuator means positioned in the housing intermediate the upper and lower hooks, adapted to receive a tail member from the handle assembly, and operative in response to turning movement of the tail member to move the upper and lower hooks in unison between their unlatched and latched positions. This arrangement provides multi-point security while minimizing latch expense and minimizing the required modification of the existing door structure.

According to a further feature of the invention, the hooks are pivotally mounted in the housing and the hooks move in opposite directions about their respective pivot axes. The opposing hook arrangement precludes vertical movement of the door to defeat the latch.

According to a further feature of the invention, the actuator means comprises upper and lower actuators positioned in vertically spaced side-by-side relation in the housing and each pivotally mounted in the housing and the actuators are ganged together by a gang link so that pivotal movement of one actuator generates corresponding pivotal movement of the other actuator. This twin actuator arrangement allows the latch to be used with handle assemblies having a center mounted thumb turn/key lock as well as with handle assemblies having an offset mounted thumb turn/key lock.

According to a further feature of the invention, the housing includes a sidewall and the sidewall defines upper and lower holes for passage of upper and lower fasteners utilized to attach the handle assembly to the stile of the door. This arrangement allows the fastener elements of the handle assembly to act to increase the security of the latch.

According to a further feature of the invention, the latch further includes an upper link interconnecting the upper actuator and the upper hook and a lower link interconnecting the lower actuator and the lower hook, the upper housing sidewall hole is positioned vertically between the actuator means and the upper hook, and the lower housing sidewall hole is positioned vertically between the actuator means and the lower hook. This arrangement provides a compact packaging for the latch while retaining the ability to utilize the handle fasteners to augment the security of the latch.

According to a further feature of the invention, the actuator means includes a pivot arm mounted at one end thereof for pivotal movement in the housing about a pivot axis and including a radially extending slot provided at another end of the arm; the housing defines an arcuate slot centered on the pivot axis and intersecting the pivot arm slot; the latch further includes a pin passing through the housing and pin arm slots and means operatively connecting the pin to the one of the hooks; the housing further defines a tail end slot portion communicating with one end of the arcuate slot and extending inwardly therefrom toward the pivot axis; and the latch further includes spring means biasing the pivot arm for movement about the pivot axis in a direction to cause the pin to move inwardly into the tail end slot portion following movement of the pin to the one end of the arcuate slot. This arrangement allows the latch to move automatically to a locked configuration following movement of the hooks to their latched positions.

BRIEF DESCRIPTION OF THE DRAWINGS

FIG. 1 is a somewhat schematic view, looking from inside to outside, of a typical sliding patio door installation;

FIGS. 2 and 3 are side elevational and plan views, respectively, of the invention latch;

FIGS. 16 and 17 are detail views of a hook utilized in the invention latch.

DETAILED DESCRIPTION OF THE PREFERRED EMBODIMENT

Figure 4:
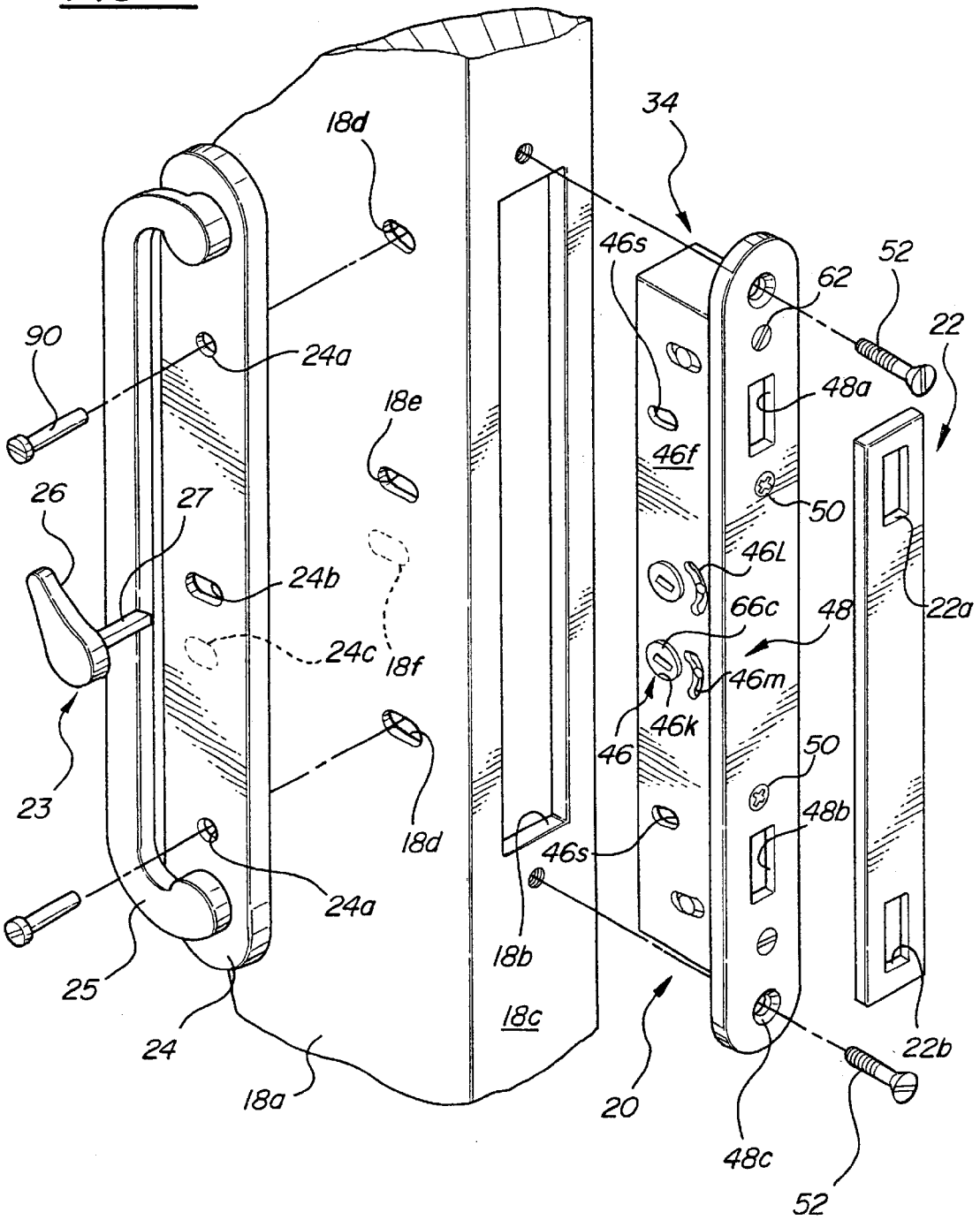
FIG. 4 is an exploded perspective view of a sliding door assembly utilizing the invention latch.

FIG. 1 illustrates a typical sliding patio door installation in which fixed left and right doors 10 and 12 are positioned at the left and right ends of an opening 14 in a building wall 16 and a sliding door 18 is arranged to move between the open position seen in FIG. 1 to a closed position in which the stile 18*a* of the sliding door is positioned against a jamb 12*a* defined by the fixed door 12 so that a latch 20 carried by stile 18*a* may coact with a keeper structure 22 defined on the jamb 12*a* to maintain the sliding door in a closed position.

According to the invention, latch 20 is a multipoint latch that is simple in design, inexpensive, and readily installed, with a minimum of door modification, in a wide variety of sliding patio doors.

Figure 10:
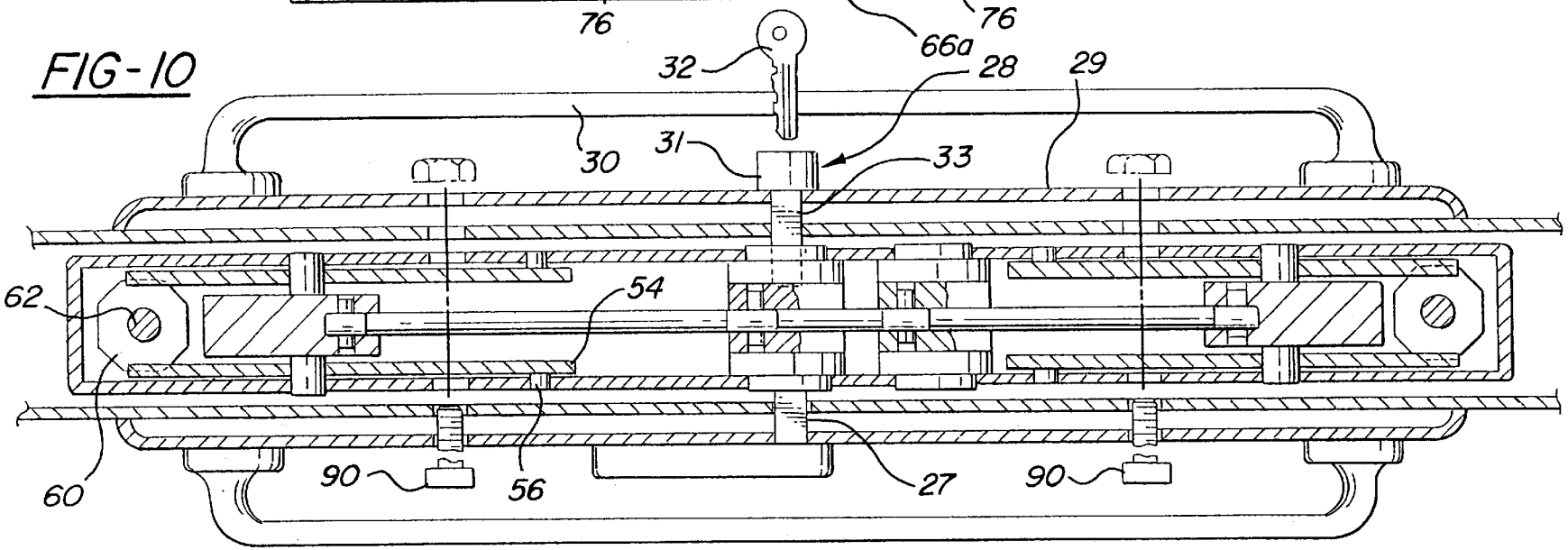
FIG. 10 is a plan view of the invention latch with a latch trim plate removed to reveal the inner workings of the latch.
Figure 11:
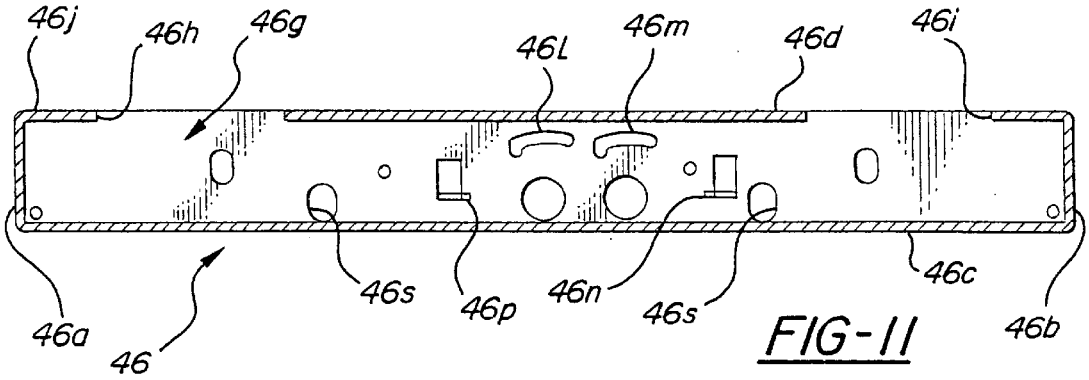
FIG. 11 is a cross-sectional view of the latch housing.

The invention multi-point sliding door latch is adapted to be fitted in a mortise or opening 18*b* (FIG. 4) in the lock face 18*c* of the stile 18*a* of the sliding door and is arranged for coaction with keeper structure 22 positioned on the associated jamb 12*a* and for coaction with a handle assembly 23 including an escutcheon plate 24 mounted on the inside face of the stile 18*a* of the sliding door, a handle 25 mounted on the escutcheon plate, and a thumb turn 26 mounted centrally on the escutcheon plate and including a tail member 27 operated by the thumb turn. It will be understood that the door handle assembly 23 seen in FIGS. 1 and 4 is an inside door handle assembly and that the sliding door 18 further includes an outside door handle assembly 28 (FIG. 10) including an escutcheon plate 29 mounted on the outside face of stile 18*a*, a handle 30 mounted on the escutcheon plate, and a key lock 31 mounted centrally on the escutcheon plate, operated by a key 32, and controlling a tail member 33.

Latch 20, broadly considered, includes a housing assembly 34, upper and lower hooks 36 and 38, upper and lower hook adjustment means 39, actuator means 40 operative in response to turning movement of tail member 27/32 to move the upper and lower hooks in unison between latched and unlatched positions, and locking means 41.

The various elements of the latch are preferably formed of suitable ferrous materials.

Housing assembly 34 includes a unitary rectilinear hollow housing 46 and a trim plate 48.

Housing 46 is formed of two or more parts in a stamping operation and includes (FIGS. 2, 3, 4, and 11) a top wall 46*a*, a bottom wall 46*b*, a rear wall 46*c*, a front wall 46*d*, and sidewalls 46*e* and 46*f* coacting to define a vertically elongated hollow interior 46*g* accessible through upper and lower rectangular apertures 46*h* and 46*i* in the front wall 46*d*.

Trim plate 48 has a vertically elongated planar configuration, is positioned in overlying relation to the front wall 46*d* of housing 46 utilizing screws 50, and includes upper and lower rectangular apertures 48*a* and 48*b* respectively overlying housing apertures 46*h* and 46*i*. Housing 46 is sized to fit within opening or mortise 18*b* in the lock face 18*c* of the stile of the sliding door with trim plate 48 overlying the lock face in surrounding relation to opening 18*b* and screws 52 passing through holes 48*c* in the upper and lower ends of the trim plate to secure the latch to the lock face.

Upper hook 36 (FIGS. 16 and 17) has a laminar construction and includes a bifurcated hub portion 36*a*, defining a central aperture 36*b*, and a hook portion 36*c*.

Figure 12:
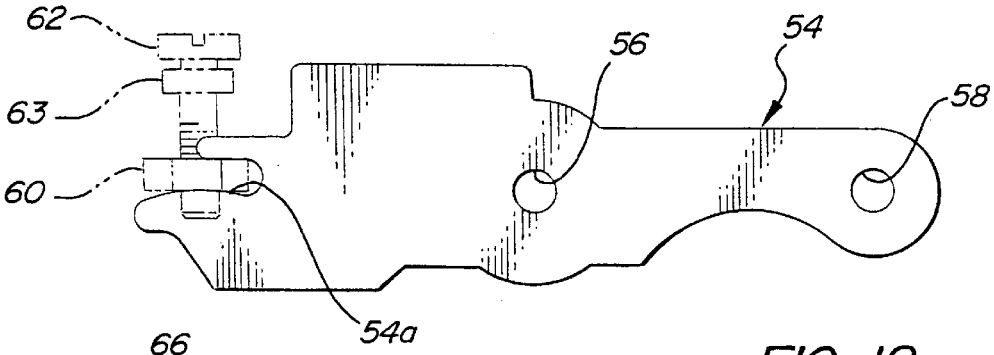
FIG. 12 is a detail view of an adjuster link utilized in the invention latch.

Upper hook adjustment means 39 includes identical left and right adjustment arms 54 (FIG. 12) interconnected by a central pin 56 passing fixedly through upper hook aperture 36*b*, a pivot pin 58 pivotally mounting the lower end of each arm in suitable apertures in housing sidewalls 46*f*, 46*g*, and a slot 54*a* formed in the upper end of each arm. A nut 60 is received at its peripheral edges in the slots 54*a* of the left and right arms and the nut is moved forwardly and rearwardly via an adjustment screw 62 passing through trim plate 48 and through an aperture in end portion 46*j* of the upper wall of the housing.

It will be seen that turning movement of adjuster screw 62 threadably moves nut 60 forwardly and rearwardly to pivot arms 54 about the axis of pins 58 and thereby, via pin 56, move hook 36 forwardly and rearwardly within the hollow of the housing. A lock nut 63 maintains the pivot arms in any position of adjustment.

Lower hook 38 and lower hook adjustment means 39 are identical to the upper hook and the upper adjustment means except for their orientation within the housing. Specifically, note that with the hooks in their latched positions (FIG. 7) the hook portion 36*c* of the upper hook points downwardly and the hook portion 38*c* of the lower hook points upwardly in opposing relation to hook portion 36*c*.

Actuator means 40 includes upper and lower actuators 64 and 66, a gang link 70, an upper link 72, and a lower link 74.

Figure 14:
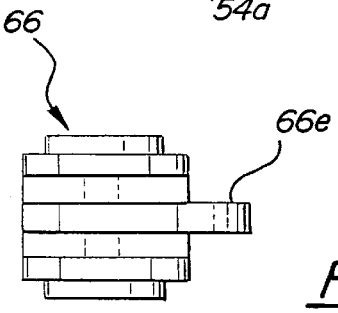
FIGS. 13–15 are detail views of an actuator utilized in the invention latch.
Figure 13:
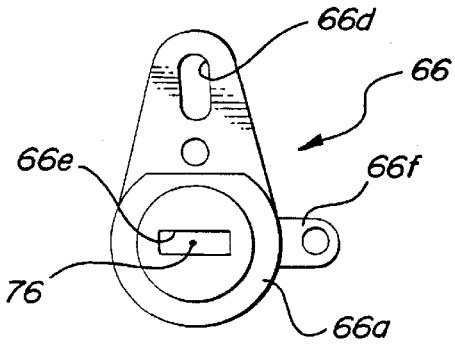
Figure 15:
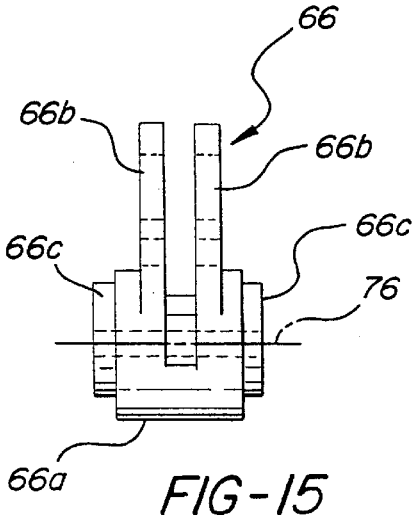

Lower actuator 66 (FIGS. 13–15) is in the form of a pivot arm and includes a hub portion 66*a* and spaced eccentric arm portions 66*b*. Hub portion 66*a* defines left and right trunnions 66*c* for journaling in suitable apertures 46*k* in the left and right sidewalls 46*e*,46*f* of housing 46 so as to mount the hub portion of the pivot arm for rotation within the housing about a pivot axis 76. A radially extending slot 66*d* is provided in each eccentric arm 66*b* and a rectangular drive slot 66*e*, sized to receive tail member 27/33, extends through the hub portion 66*a* in symmetric relation to pivot axis 76.

Upper actuator or pivot arm 64 is identical to lower pivot arm 66 but is reverse mounted in the housing, as compared to lower pivot arm 66, so that a lug portion 66*f* extending radially outwardly from hub 66*a* points generally downwardly whereas the corresponding hub portion 64*f* of the upper pivot arm points generally upwardly.

The pivot axis 76 of upper pivot arm 64 is preferably located on the vertical center line of latch housing 46 and the pivot axis 76 of lower pivot arm 66 is preferably located offset below (for example, by ¾") the vertical center line of the latch housing.

Gang link 70 extends between upper and lower pivot arms 64, 66 in parallel relation to the rear edge 46*i* of the housing, is pivotally connected at its upper and lower ends to the eccentric arm portions of the upper and lower pivot arms by pivot pins 80, and has a length corresponding to the distance between the pivot axes 76, 76 of the upper and lower pivot arms so that the gang link 70 coacts with the upper and lower pivot arms and with the portion of the housing between axes 76, 76 to form a parallelogram linkage.

Upper link 72 has a compound curvilinear configuration and includes a lower end 72*a* carrying a pivot pin 82 received in the slots 66*d* of the upper pivot arm and an upper end 72*b* carrying a pivot pin 84 mounted in aligned apertures 36*d* in the bifurcated hub portion 36*a* of the upper hook.

Lower connector link 74 is generally straight, includes a pivot pin 86 at its upper end 74*a* received in the slots 66*d* of lower pivot arm 66, and carries a further pivot pin 88 at its lower end 74*b* pivotally mounted in aligned apertures in the bifurcated hub portion of the lower hook.

Figure 5:
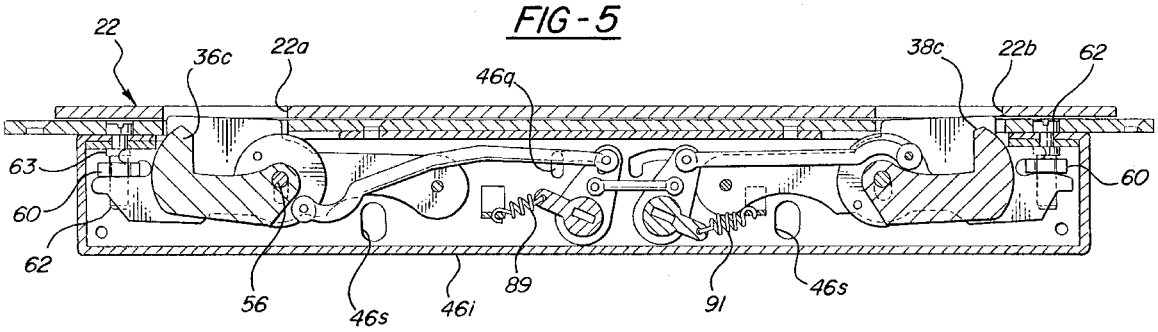
FIGS. 5–8 are progressive views showing the movement of the invention latch from an unlatched, to a latched, to a locked position.
Figure 6:
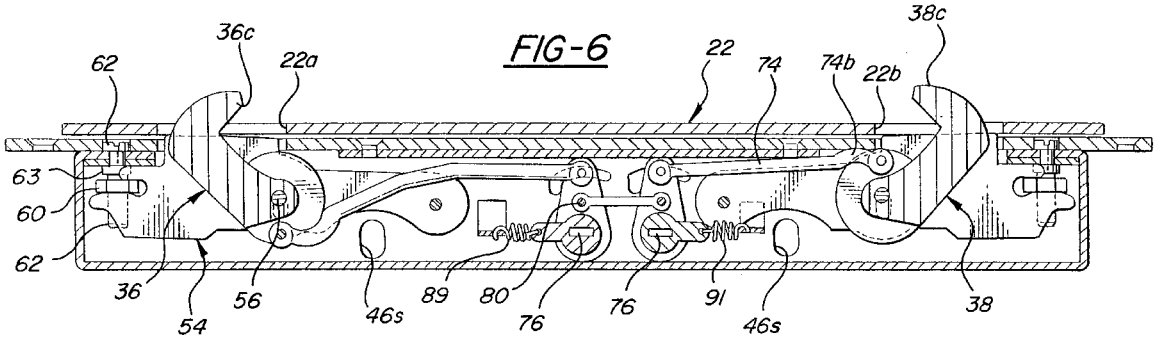
Figure 7:
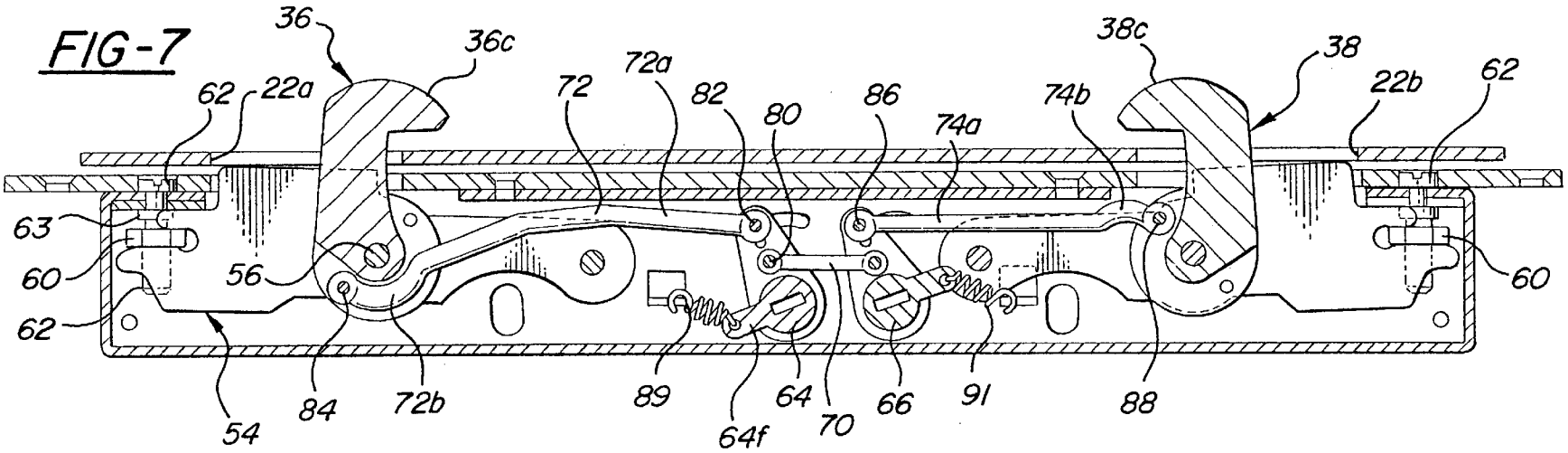

The described actuating means operates in response to insertion of a tail member from the thumb turn or from the key lock into slot 64*e* or 66*e* to move the upper and lower hooks between the fully retracted or unlatched position of FIG. 5, to the intermediate or transient position of FIG. 6, and thereafter to the latched position of FIG. 7.

It will be seen that, as viewed in FIGS. 5–7, upper hook 36 moves from its unlatched to its latched position in a clockwise direction whereas lower hook 38 moves from its unlatched to its latched position in a counter-clockwise direction. As the hooks move to their latched positions, hook portion 36*c* of upper hook 36 enters and passes through an upper opening 22*a* in keeper plate 22 for latching coaction with the keeper plate and hook portion 38*c* of lower hook 38 enters and passes through a lower opening 22*b* in keeper plate 22 for latching coaction with the keeper plate.

Locking means 41 (FIG. 9) comprises an arcuate slot 46*l* centered on the pivot axis 76 of upper pivot link 64; an arcuate slot 46*m* centered on the pivot axis 76 of pivot link 66; a coil spring 89 mounted in compression between a lug 46*n* struck from housing wall 46*e* and a pin 64*g* provided on the free end of lug 64*f*; and a further coil spring 91 mounted in compression between a lug 46*p* struck from housing wall 46*e* and a pin 66*g* provided on the free end of lug 66*f*. Slot 46*l* has a tail end section 46*q* extending from the upper end of the slot in a direction perpendicular to the rear edge 46*i* of the housing and slot 46*m* has a tail portion 46*r* extending from the upper end of the slot in a direction perpendicular to housing rear edge 46*i*. Pin 86 carried by the upper end 74*a* of lower connecting link 74, in addition to passing through slots 66*d* of pivot arm 66, is also received at its opposite ends in slot 46*m* in housing sidewall 46*e* and in a corresponding slot in housing sidewall 46*f*, and pin 82, carried by the lower end 72*a* of upper connecting link 72, in addition to passing through slots 64*d* of pivot arm 64, is also received slidably at its opposite ends in slot 46*l* in the housing wall 46*e* and in a corresponding slot in housing sidewall 46*f*.

Figure 8:
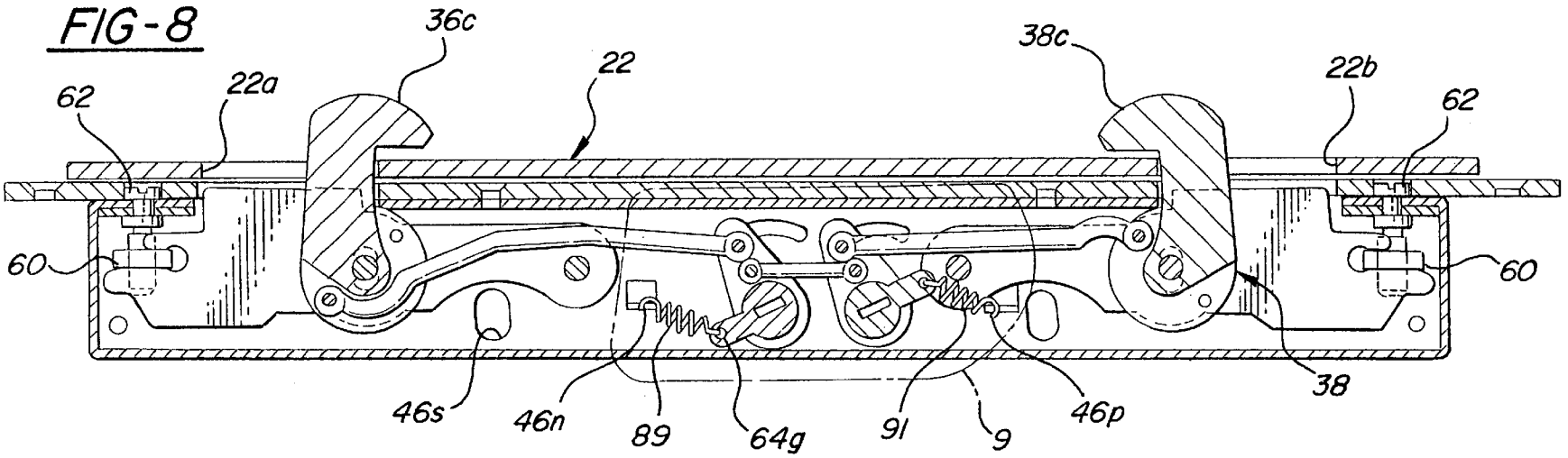
Figure 9:
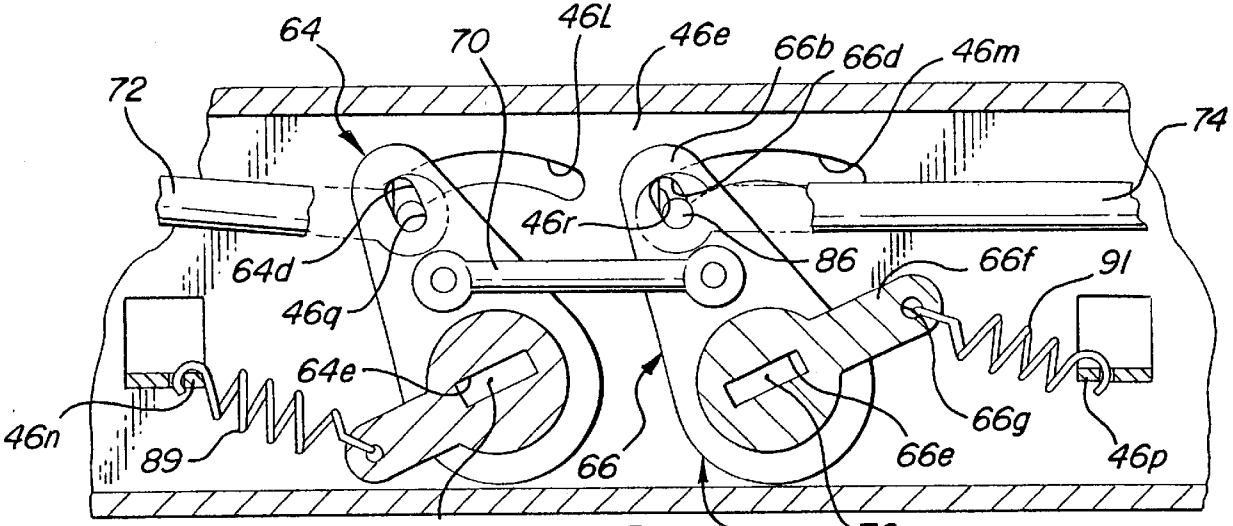
FIG. 9 is a detail view taken within the circle 9 of FIG. 8.

As the hooks reach their latched positions of FIG. 7, the pins 82, 86 carried by the lower end of upper link 72 and the upper end of lower link 74 respectively reach the upper ends of their respective slots 46*l*, 46*m* and at that time are open to slot tail portions 46*q*, 46*r*. At this time, compressed spring 91 acts through its radius arm with respect to the pivot axis 76 of pivot arm 66 to continue the counter-clockwise pivotal movement of arm 66 with the result that the pin 86 and thereby the link 74 are moved rearwardly into the tail end 46*r* of slot 46*m* while, simultaneously, compressed spring 89 acts through its radius arm with respect to the pivot axis 76 of link 64 to continue the counter-clockwise pivotal movement of link 64 and thereby move pin 82 and thereby link 72 rearward into the tail portion 46*q* of link 46*l*. This seating of the pins 82,86 in the groove tail portions 46*q*,46*r* is best seen in FIGS. 8 and 9. It will be seen that, in this position, any force exerted on lower hook 38 in a direction to attempt to move the hook clockwise toward its unlatched position simply presses pin 86 tighter against the lower wall of slot tail portion 46*r* to positively preclude the unlatching movement of the hook. Similarly, any attempt to move upper hook 36 counter-clockwise in an unlatching direction results in the pin 82 being pressed more tightly against the lower wall of the tail portion 46*q* of the slot 46*l* so as to positively preclude such unlatching movement.

The latch may be readily moved to its unlatched position, to allow opening of the sliding door, by clockwise turning movement of the tail piece associated with the thumb turn or the key lock. Specifically, the initial clockwise pivotal movement of the pivot arms causes the slots 64*d*, 66*d* to move the pins 82, 86 out of the tail portions of the slots 46*l*, 46*m* and into the main body portion of the slots whereby the pivot arms may now undergo further clockwise movement to move the hooks to the transient or intermediate position of FIG. 6 and thereafter to the fully unlatched position of FIG. 5.

In the assembled relation of the latch and door handle assembly, the handle fastener members 90 pass through upper and lower holes 24*a* in escutcheon plate 24, through oversize or oblong upper and lower holes 18*d* in the stile, through oversized or oblong upper and lower holes 46*s* in the housing sidewall 46*f*, and through aligned oversized or oblong upper and lower holes 46*s* in the housing sidewall 46*e* for engagement with a suitable coacting fastener element such as a nut. With this arrangement, prying of the latch 20 out of the opening or mortise 18*b* is precluded not only by the threaded engagement of screws 52 with the stile but further by the passage of fasteners 90 through the housing of the latch so that the latch, in effect, can only be pried loose from the stile by destroying the stile and/or the latch housing. The upper, oversized housing holes 46*s* will be seen to be located vertically between upper pivot arm 64 and upper hook 36 and the lower, oversized housing holes 46*s* will be seen to be located vertically between lower pivot arm 66 and lower hook 38.

The invention will be seen to provide a multipoint latch for a sliding door that is simple in construction, inexpensive, and readily installed in a wide variety of door environments. Specifically, the housing of both upper and lower hooks in a single unitary housing allows the latch to be installed in standard sliding door stiles simply by enlarging the opening or mortise in the lock face of the stile; the ganged together upper and lower actuators allow the same latch to be used either in association with a door handle assembly employing a centrally mounted thumb turn/key cylinder (with tail member 27/33 passing through oversized central escutcheon aperture 24*b* and oversized central stile aperture 18*e*) or a handle assembly employing an offset thumb turn/key cylinder arrangement with upper pivot arm 64 utilized to accommodate center line mounting and lower thumb turn 66 utilized (with suitable machining of apertures 24*c* and 18*f* in the escutcheon plate and stile respectively) to accommodate offset thumb screws/key cylinder arrangements; the passage of the handle fastening elements through the housing of the latch adds significantly to the strength and security of the latch; standard hole locations for the handle and stile may be maintained; the upper and lower latches provide secure multi-point latching; and the opposed disposition of the upper and lower hooks precludes vertical movement of the door to defeat the latch.

Whereas a preferred embodiment of the invention has been illustrated and described in detail, it will be apparent that various changes may be made in the disclosed embodiment without departing from the scope or spirit of the invention.

I claim:

1. A multi-point sliding door latch adapted to be fitted in a single opening in a lock face of a stile of a door and arranged for coaction with a keeper structure on a associated jamb and for coaction with a handle assembly mounted on the stile of the door and including a tail member operated by a thumb turn or a key lock, the latch comprising:

a unitary hollow housing adapted to fit in the stile opening;

a pair of vertically spaced upper and lower hooks each pivotally mounted in the housing for movement in opposite pivotal directions between a retracted, unlatched position within a hollow of the housing and an extended, latched position extending out of the hollow of the housing for latching coaction with the keeper structure;

and actuator means positioned in the housing intermediate the upper and lower hooks and including a pivot arm adapted to receive a tail member from the handle assembly and mounted on the housing for pivotal movement about a fixed axis and a linkage mechanism interconnecting the pivot arm and the upper and lower hooks and operative in response to turning movement of the pivot arm in one direction about the fixed axis by the tail member to move the upper and lower hooks in unison but in opposite pivotal directions between their unlatched and latched positions.

2. A latch according to claim 1 wherein the actuator means includes upper and lower pivot arms positioned in vertically spaced side by side relation in the housing and each pivotally mounted in the housing, and the pivot arms are ganged together by a gang link so that pivotal movement of one pivot arm generates corresponding pivotal movement of the other pivot arm.

3. A latch according to claim 2 wherein the latch further includes an upper link interconnecting the upper first arm and the upper hook and a lower link interconnecting the lower first arm and the lower hook.

4. A latch according to claim 1 wherein the housing includes a side wall and the side walls define upper and lower openings for passage of upper and lower fasteners utilized to attach the handle assembly to the stile of the door.

5. A latch according to claim 4 wherein the upper opening is positioned vertically between the actuator means and the upper hook and the lower opening is positioned vertically between the actuator means and the lower hook.

6. A multi-point sliding door latch and handle assembly adapted to be fitted on a stile of a door, comprising;

a unitary hollow housing adapted to fit in an opening in a lock face of the stile;

a pair of vertically spaced upper and lower hooks each pivotally mounted in the housing for movement in opposite pivotal directions between a retracted, unlatched position within the hollow of the housing and an extended latched position extending out of the hollow of the housing for latching coaction with a keeper structure on an associated jamb;

actuator means positioned in the housing intermediate the upper and lower hooks, adapted to receive a tail member and operative in response to movement of the tail member to move the upper and lower hooks in unison between their unlatched and latched positions; and a handle assembly including an escutcheon plate adapted to be mounted on the stile of the door, a handle mounted on the escutcheon plate, and a latch actuator device mounted on the escutcheon plate and including the tail member which is adapted to extend through an aperture in the stile for receipt by the actuator means.

7. A multi-point sliding door latch and handle assembly according to claim 6 wherein:

the unitary hollow housing includes a side wall defining upper and lower holes providing access to the hollow interior of the housing; and the handle assembly includes upper and lower fastener members extending through upper and lower holes in the escutcheon plate, through the stile, and through the upper and lower holes in the housing sidewall.

8. A multi-point sliding door latch and handle assembly according to claim 7 wherein the hooks open toward each other in their latched positions.

9. A multi-point sliding door latch and handle assembly according to claim 7 wherein the actuator means comprises upper and lower actuators positioned in vertically spaced side-by-side relation in the housing and each pivotally mounted in the housing, and the actuators are ganged together by a gang link so that pivotal movement of one actuator generates corresponding pivotal movement of the other actuator.

10. A multi-point sliding door latch and handle assembly according to claim 9 wherein the assembly further includes an upper link interconnecting the upper actuator and the upper hook and a lower link interconnecting the lower actuator and the lower hook.

11. A multi-point sliding door latch and handle assembly according to claim 7 wherein;

the upper hook is positioned in the housing above the upper housing side wall hole;

the lower hook is positioned in the housing below the lower housing side wall hole; and the actuator means are positioned in the housing between the upper and lower housing side wall holes.

12. A multi-point sliding door latch adapted to be fitted in a single opening in a lock face of a stile of a door and arranged for coaction with a keeper structure on an associated jamb and for coaction with a handle assembly mounted on the stile of the door and including a tail member operated by a thumb turn or a key lock, the latch comprising:

a unitary hollow housing adapted to fit in the stile opening;

a pair of vertically spaced upper and lower hooks each mounted in the housing for movement between a retracted, unlatched position within the hollow of the housing and an extended, latched position extending out of the hollow of the housing for latching coaction with the keeper structure;

upper and lower actuators positioned in vertically spaced side-by-side relation in the housing intermediate the upper and lower hooks, mounted for rotation on the housing about vertically spaced axes, and each including a socket structure adapted to receive a tail member from the handle assembly and moveable about its respective axis in response to turning movement of the tail member;

a gang link interconnecting the upper and lower actuators so that movement of one actuator generates corresponding movement of the other actuator; and means operative in response to movement of the actuators to move the upper and lower hooks in unison between their unlatched and latched positions.

13. A multi-point sliding door latch according to claim 12 wherein:

the upper and lower actuators are pivotly mounted in the housing; and the upper and lower hooks are pivotly mounted in the housing for movement in opposite pivotal directions.

14. A multi-point sliding door latch and handle assembly according to claim 13 wherein the assembly further includes an upper link interconnecting the upper actuator and the upper hook and a lower link interconnecting the lower actuator and the lower hook.

* * * * *

US006264252C1

(12) EX PARTE REEXAMINATION CERTIFICATE (5992nd)

United States Patent
Clancy

(10) Number: US 6,264,252 C1
(45) **Certificate Issued: *Nov. 6, 2007**

(54) MULTI-POINT SLIDING DOOR LATCH

(75) Inventor: John M. Clancy, Clawson, MI (US)

(73) Assignee: Sash Controls, Inc., Ferndale, MI (US)

Reexamination Request:
No. 90/006,949, Feb. 23, 2004

Reexamination Certificate for:

| | |
|---|---|
| Patent No.: | **6,264,252** |
| Issued: | **Jul. 24, 2001** |
| Appl. No.: | **09/170,178** |
| Filed: | **Oct. 13, 1998** |

( * ) Notice: This patent is subject to a terminal disclaimer.

Related U.S. Application Data

(63) Continuation of application No. 08/786,667, filed on Jan. 21, 1997, now Pat. No. 5,820,170.

(51) Int. Cl.

| | |
|---|---|
| ***E05B 65/08*** | (2006.01) |
| ***E05C 9/00*** | (2006.01) |
| ***E05C 9/02*** | (2006.01) |

(52) U.S. Cl. ..... 292/196; 292/123; 292/97

(58) Field of Classification Search ..... None
See application file for complete search history.

(56) References Cited

U.S. PATENT DOCUMENTS

| | | | |
|---|---|---|---|
| 1,716,113 | A | 6/1929 | Carlson |
| 2,739,002 | A | 3/1956 | Johnson |
| 3,162,472 | A | 12/1964 | Rust |
| 3,413,025 | A | 11/1968 | Sperry |
| 3,437,364 | A | 4/1969 | Walters |
| 3,586,360 | A | 6/1971 | Perrotta |
| 3,899,201 | A | 8/1975 | Paioletti |
| 3,904,229 | A | 9/1975 | Waldo |
| 4,076,289 | A | 2/1978 | Fellows et al. |
| 4,116,479 | A | 9/1978 | Poe |

(Continued)

FOREIGN PATENT DOCUMENTS

| | | |
|---|---|---|
| AU | 84928 | 12/1920 |
| DE | 1002656 | 2/1957 |
| DE | 1584112 | 9/1969 |
| DE | 2639065 | 3/1977 |
| EP | 341173 B1 | 11/1989 |

(Continued)

OTHER PUBLICATIONS

"Window Executive" Catalog, Summer 1996 Issue, vol. 2, Issue 6, pp. 9–10.

(Continued)

*Primary Examiner*—David O. Reip

(57) ABSTRACT

A multi-point sliding door latch adapted to be fitted in a single opening in the lock face of the stile of the sliding door and arranged for coaction with a keeper structure on an associated jamb and for coaction with a handle assembly mounted on the stile of the sliding door and including a tail member operated by a thumb turn or a key lock. The latch includes a unitary hollow housing sized to fit in the stile opening, a pair of vertically spaced upper and lower hooks each pivotally mounted in the housing for movement between a retracted unlatched position within the hollow of the housing and an extended latch position extending out of the hollow of the housing for latching coaction with the keeper structure; upper and lower pivot arms pivotally mounted in the housing in vertically spaced side-by-side relation between the upper and lower hooks and each adapted to receive a tail member of the handle assembly; a gang link connecting the upper and lower pivot arms so that pivotal movement of one pivot arm generates corresponding pivotal movement of the other pivot arm; an upper link interconnecting the upper pivot arm and the upper hook; and a lower link interconnecting the lower pivot arm and the lower hook.

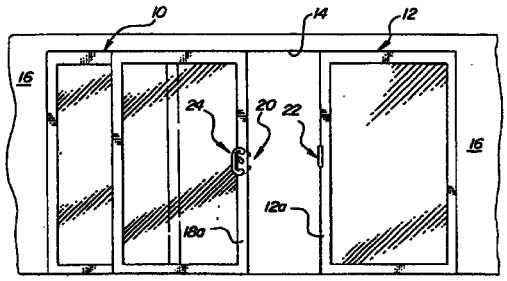

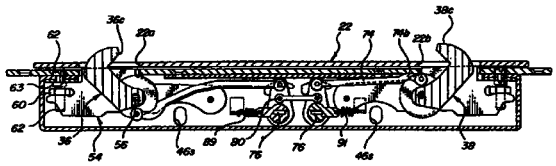

U.S. PATENT DOCUMENTS

| | | | | |
|---|---|---|---|---|
| 4,132,438 | A | | 1/1979 | Guymer |
| 4,602,812 | A | | 7/1986 | Bourne |
| 4,643,005 | A | | 2/1987 | Logas |
| 4,973,091 | A | | 11/1990 | Paulson |
| 5,092,144 | A | | 3/1992 | Fleming et al. |
| 5,118,151 | A | | 6/1992 | Nicholas, Jr. et al. |
| 5,125,703 | A | | 6/1992 | Clancy et al. |
| 5,171,050 | A | | 12/1992 | Mascotte |
| 5,722,704 | A | * | 3/1998 | Chaput et al. ..... 292/26 |
| 5,791,700 | A | | 8/1998 | Biro |
| 5,906,403 | A | | 5/1999 | Bestler et al. |
| 5,951,068 | A | | 9/1999 | Strong et al. |
| 6,094,869 | A | | 8/2000 | Magoon et al. |
| D433,916 | S | | 11/2000 | Frey |
| 6,282,929 | B1 | | 9/2001 | Eller et al. |
| 6,502,435 | B2 | | 1/2003 | Watts et al. |
| 6,637,784 | B1 | | 10/2003 | Hauber et al. |
| 6,672,632 | B1 | | 1/2004 | Speed et al. |
| 6,688,656 | B1 | | 2/2004 | Becken |
| 6,733,051 | B1 | | 5/2004 | Cowper |
| 6,776,441 | B2 | | 8/2004 | Liu |

FOREIGN PATENT DOCUMENTS

| | | | |
|---|---|---|---|
| EP | 359284 | A2 | 3/1990 |
| EP | 661409 | B1 | 7/1995 |
| EP | 0 661 409 | A2 | 7/1995 |
| FR | 1142316 | | 3/1957 |
| FR | 2339723 | | 9/1977 |
| FR | 2342390 | | 9/1977 |
| GB | 1498849 | | 1/1978 |
| GB | 1575900 | | 10/1980 |
| GB | 2076879 | A | 12/1981 |
| GB | 2126644 | A | 3/1984 |
| GB | 2168747 | A | 6/1986 |
| GB | 2 196 375 | A | 4/1988 |
| GB | 2196375 | A | 4/1988 |
| GB | 2 212 849 | A | 8/1989 |
| GB | 2212849 | A | 8/1989 |
| GB | 2230294 | A | 10/1990 |
| GB | 2 265 935 | A | 10/1993 |
| GB | 2265935 | A | 10/1993 |
| IT | 614960 | | 1/1961 |
| SE | 309372 | | 3/1969 |
| WO | 96/25576 | | 8/1996 |

OTHER PUBLICATIONS

"We mold solutions", Vanguard Plastics Ltd catalog, ISO 9001:2000, 21 pages.

W & F Mfg., Inc., Multi–Point Latch, 1 pg.

Builders Hardware 2345 Series Dual Hook Mortise Lock product literature, undated (1 pg.).

Imperial USA Sliding Door Multipoint Lock drawing, undated (1 pg.).

Imperial USA "What Finishes Do You Offer?" product advertisement, from "Window & Door" Magazine, 2003 or 2004 (1 pg.).

Imperial USA's Keynetic™—Multi–point Mortise Deadlock product literature, undated (3 pgs.).

Truth Hardware's Two–point mortise lock product literature, undated (8 pgs.).

Vanguard Plastics Ltd.'s Window & Door Catalogue, Aug. 2004 (excerpt) (3 pgs.).

Photographs of Builders Hardware Inc.'s two–hook mortise lock (7 pgs.).

Photographs of Imperial USA's two–hook mortise lock (9 pgs.).

Photographs of Roto's two–hook mortise lock (6 pgs.).

Photographs of Truth Hardware's two–hook mortise lock (5 pgs.).

Photographs of Vanguard Plastics Ltd.'s two–hook mortise lock (5 pgs.).

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 30–35:

Latch 20, broadly considered, includes a housing assembly 34, upper and lower hooks 36 and 38, upper and lower hook adjustment means [39], actuator means [40] operative in response to turning movement of tail member 27/[32]*33* to move the upper and lower hooks in unison between latched and unlatched positions, and locking means [41].

Column 3, line 62 to column 4, line 5:

Upper hook adjustment means [39] includes identical left and right adjustment arms 54 (FIG. 12) interconnected by a central pin 56 passing fixedly through upper hook aperture 36b, a pivot pin 58 pivotally mounting the lower end of each arm in suitable apertures in housing sidewalls 46f, 46g, and a slot 54a formed in the upper end of each arm. A nut 60 is received at its peripheral edges in the slots 54a of the left and right arms and the nut is moved forwardly and rearwardly via an adjustment screw 62 passing through trim plate 48 and through an aperture in end portion 46j of the upper wall of the housing.

Column 4, lines 12–18:

Lower hook 38 and lower hook adjustment means [39] are identical to the upper hook and the upper adjustment means except for their orientation within the housing. Specifically, note that with the hooks in their latched positions (FIG. 7) the hook portion 36c of the upper hook points downwardly and the hook portion 38c of the lower hook points upwardly in opposing relation to hook portion 36c.

Column 4, lines 19–20:

Actuator means [40] includes upper and lower actuators 64 and 66, a gang link 70, an upper link 72, and a lower link 74. *In the depicted embodiment, the two actuators 64, 66 are pivotally mounted to the housing as separate members.*

Column 4, lines 42–49:

Gang link 70 extends between upper and lower pivot arms 64, 66 in parallel relation to the rear [edge 46i] *wall 46c* of the housing, is pivotally connected at its upper and lower ends to the eccentric arm portions of the upper and lower pivot arms by pivot pins 80, and has a length corresponding to the distance between the pivot axes 76, 76 of the upper and lower pivot arms so that the gang link 70 coacts with the upper and lower pivot arms and with the portion of the housing between axes 76, 76 to form a parallelogram linkage.

Column 4, lines 52–56:

Upper link 72 has a compound curvilinear configuration and includes a lower end 72a carrying a pivot pin 82 received in the slots [66d] *64d* of the upper pivot arm and an upper end 72b carrying a pivot pin 84 mounted in aligned apertures 36d in the bifurcated hub portion 36a of the upper hook.

Column 5, lines 11–31:

Locking means [41] (FIG. 9) comprises an arcuate slot 46l centered on the pivot axis 76 of upper pivot link 64; an arcuate slot 46m centered on the pivot axis 76 of pivot link 66; a coil spring 89 mounted in compression between a lug 46n struck from housing wall 46e and a pin [64g] provided on the free end of lug [64f]; and a further coil spring 91 mounted in compression between a lug 46p struck from housing wall 46e and a pin [66g] provided on the free end of lug 66f. Slot 46l has a tail end section 46q extending from the upper end of the slot in a direction perpendicular to the rear [edge 46i] *wall 46c* of the housing and slot 46m has a tail portion 46r extending from the upper end of the slot in a direction perpendicular to housing rear [edge 46i] *wall 46c*. Pin 86 carried by the upper end 74a of lower connecting link 74, in addition to passing through slots 66d of pivot arm 66, is also received at its opposite ends in slot 46m in housing sidewall 46e and in a corresponding slot in housing sidewall 46f, and pin 82, carried by the lower end 72a of upper connecting link 72, in addition to passing through slots 64d of pivot arm 64, is also received slidably at its opposite ends in slot 46l in the housing wall 46e and in a corresponding slot in housing sidewall 46f.

Column 5, lines 32–56:

As the hooks reach their latched positions of FIG. 7, the pins 82, 86 carried by the lower end of upper link 72 and the upper end of lower link 74 respectively reach the upper ends of their respective slots 46l, 46m and at that time are open to slot tail portions 46q, 46r. At this time, compressed spring 91 acts through its radius arm with respect to the pivot axis 76 of pivot arm 66 to continue the counter-clockwise pivotal movement of arm 66 with the result that the pin 86 and thereby the link 74 are moved rearwardly into the tail end 46r of slot 46m while, simultaneously, compressed spring 89 acts through its radius arm with respect to the pivot axis 76 of link 64 to continue the counter-clockwise pivotal movement of link 64 and thereby move pin 82 and thereby link 72 rearward into the tail portion 46q of [link] *slot* 46l. This seating of the pins 82,86 in the groove tail portions 46q, 46r is best seen in FIGS. 8 and 9. It will be seen that, in this position, any force exerted on lower hook 38 in a direction to attempt to move the hook clockwise toward its unlatched position simply presses pin 86 tighter against the lower wall of slot tail portion 46r to positively preclude the unlatching movement of the hook. Similarly, any attempt to move upper hook 36 counter-clockwise in an unlatching direction results in the pin 82 being pressed more tightly against the lower wall of the tail portion 46q of the slot 46l so as to positively preclude such unlatching movement.

AS A RESULT OF REEXAMINATION, IT HAS BEEN DETERMINED THAT:

Claims 1–4, 6 and 9–13 are determined to be patentable as amended.

Claims 5, 7, 8 and 14, dependent on an amended claim, are determined to be patentable.

New claims 15–24 are added and determined to be patentable.

1. A multi-point sliding door latch adapted to be fitted in a single opening in a lock face of a stile of a door and arranged for coaction with a keeper structure on [a] *an* associated jamb and for coaction with a handle assembly mounted on the stile of the door and including a tail member operated by a thumb turn or a key lock, the latch comprising:

a *single* unitary hollow housing *defining a single vertically elongated hollow interior, the single housing* adapted to fit in the stile opening;

a pair of vertically spaced upper and lower hooks each pivotally mounted in the *single hollow interior of the single* housing for movement in opposite pivotal directions between a retracted, unlatched position within [a] *the single* hollow *interior* of the *single* housing and an extended, latched position extending out of the *single* hollow *interior* of the *single* housing for latching coaction with the keeper structure;

and actuator means positioned in the *single hollow interior of the single* housing intermediate the upper and lower hooks and including a *first* pivot arm adapted to receive a tail member from the handle assembly and mounted on the *single* housing for pivotal movement about a fixed axis*, a separate second pivot arm mounted on the single housing for pivotal movement in the same direction as the first pivot arm,* and a linkage mechanism interconnecting the *first* pivot arm and the upper and lower hooks and operative in response to turning movement of the *first* pivot arm in one direction about the fixed axis by the tail member to move the upper and lower hooks in unison but in opposite pivotal directions between their unlatched and latched positions.

2. A latch according to claim 1 wherein the [actuator means includes upper and lower] pivot arms *are* positioned in vertically spaced side by side relation in the housing and each pivotally mounted in the housing, and the pivot arms are ganged together by a gang link so that pivotal movement of one pivot arm generates corresponding pivotal movement of the other pivot arm.

3. A latch according to claim 2 wherein the latch further includes an upper link interconnecting the [upper] first *pivot* arm and the upper hook and a lower link interconnecting the [lower first] *second pivot* arm and the lower hook.

4. A latch according to claim 1 wherein the housing includes a side wall and the side [walls define] *wall defines* upper and lower openings for passage of upper and lower fasteners utilized to attach the handle assembly to the stile of the door.

6. A multi-point sliding door latch and handle assembly adapted to be fitted on a stile of a door, comprising [;]*:* a *single* unitary hollow housing *defining a single vertically elongated hollow interior, the single housing* adapted to fit in an opening in a lock face of the stile;

a pair of vertically spaced upper and lower hooks each pivotally mounted in the *single hollow interior of the single* housing for movement in opposite pivotal directions between a retracted, unlatched position within the *single* hollow *interior* of the *single* housing and an extended latched position extending out of the *single* hollow *interior* of the *single* housing for latching coaction with a keeper structure on an associated jamb;

actuator means positioned in the *single hollow interior of the single* housing intermediate the upper and lower hooks, adapted to receive a tail member and operative in response to movement of the tail member to move the upper and lower hooks in unison between their unlatched and latched positions*, the actuator means comprising a first pivot arm and a separate second pivot arm, both pivot arms mounted on the single housing for pivotal movement in the same direction*; and a handle assembly including an escutcheon plate adapted to be mounted on the stile of the door, a handle mounted on the escutcheon plate, and a latch actuator device mounted on the escutcheon plate and including the tail member which is adapted to extend through an aperture in the stile for receipt by the actuator means.

9. A multi-point sliding door latch and handle assembly according to claim 7 wherein the [actuator means comprises upper and lower actuators] *pivot arms are* positioned in vertically spaced side-by-side relation in the housing and each pivotally mounted in the housing, and the [actuators] *pivot arms* are ganged together by a gang link so that pivotal movement of one [actuator] *pivot arm* generates corresponding pivotal movement of the other [actuator] *pivot arm*.

10. A multi-point sliding door latch and handle assembly according to claim 9 wherein the assembly further includes an upper link interconnecting the [upper actuator] *first pivot arm* and the upper hook and a lower link interconnecting the [lower actuator] *second pivot arm* and the lower hook.

11. A multi-point sliding door latch and handle assembly according to claim 7 wherein;

the upper hook is positioned in the housing above the upper housing side wall hole;

the lower hook is positioned in the housing below the lower housing side wall hole; and the [actuator means] *pivot arms* are positioned in the housing between the upper and lower housing side wall holes.

12. A multi-point sliding door latch adapted to be fitted in a single opening in a lock face of a stile of a door and arranged for coaction with a keeper structure on an associated jamb and for coaction with a handle assembly mounted on the stile of the door and including a tail member operated by a thumb turn or a key lock, the latch comprising:

a *single* unitary hollow housing *defining a single vertically elongated hollow interior, the single housing* adapted to fit in the stile opening;

a pair of vertically spaced upper and lower hooks each mounted in the *single hollow interior of the single* housing for movement between a retracted, unlatched position within the *single* hollow *interior* of the *single* housing and an extended, latched position extending out of the *single* hollow *interior* of the *single* housing for latching coaction with the keeper structure;

upper and lower actuators positioned in vertically spaced side-by-side relation in the *single* housing intermediate the upper and lower hooks, mounted for rotation on the *single* housing about vertically spaced axes, and each including a socket structure adapted to receive a tail member from the handle assembly and moveable about its respective axis in response to turning movement of the tail member;

a gang link interconnecting the upper and lower actuators so that movement of one actuator generates corresponding movement of the other actuator; and means operative in response to movement of the actuators to move the upper and lower hooks in unison between their unlatched and latched positions.

13. A multi-point sliding door latch according to claim 12 wherein:

the upper and lower actuators are [pivotly] *pivotally*-mounted in the housing; and the upper and lower hooks are [pivotly] *pivotally* mounted in the housing for movement in opposite pivotal directions.

*15. A multi-point sliding door latch adapted to be fitted in a single opening in a lock face of a stile of a door and arranged for coaction with a keeper structure on an associated jamb and for coaction with a handle assembly mounted on the stile of the door and including a tail member operated by a thumb turn or a key lock, the latch comprising:*

*a unitary hollow housing adapted to fit in the stile opening;*

*a pair of vertically spaced upper and lower hooks each pivotally mounted in the housing for movement in opposite pivotal directions between a retracted, unlatched position within a hollow of the housing and an extended, latched position extending out of the hollow of the housing for latching coaction with the keeper structure;*

*actuator means comprising upper and lower pivot arms positioned in vertically spaced side by side relation in the housing and each pivotally mounted in the housing intermediate the upper and lower hooks, one of the pivot arms adapted to receive a tail member from the handle assembly and mounted on the housing for pivotal movement about a fixed axis between a first position corresponding to the unlatched position of the hooks and a second position corresponding to the latched position of the hooks and a linkage mechanism interconnecting one of the pivot arms and the upper and lower hooks and operative in response to turning movement of one of the pivot arms in one direction about the fixed axis by the tail member to move the upper and lower hooks in unison but in opposite directions between their unlatched and latched positions, wherein the pivot arms are ganged together by a gang link so that pivotal movement of one pivot arm generates corresponding pivotal movement of the other pivot arm; and*

*a spring mounted between the housing and at least one of the pivot arms, the spring adapted to continue pivotal movement of the at least one pivot arm toward each of the first position and the second position.*

*16. A latch according to claim 15 wherein the latch further includes an upper link interconnecting the upper pivot arm and the upper hook and a lower link interconnecting the lower pivot arm and the lower hook.*

*17. A latch according to claim 15 wherein the housing includes a side wall and the side wall defines upper and lower openings for passage of upper and lower fasteners utilized to attach the handle assembly to the stile of the door.*

*18. A latch according to claim 17 wherein the upper opening is positioned vertically between the actuator means and the upper hook and the lower opening is positioned vertically between the actuator means and the lower hook.*

*19. A multi-point sliding door latch and handle assembly adapted to be fitted on a stile of a door, comprising:*

*a unitary hollow housing adapted to fit in an opening in a lock face of the stile and including a side wall defining upper and lower holes providing access to the hollow interior of the housing;*

*a pair of vertically spaced upper and lower hooks each pivotally mounted in the housing for movement in opposite pivotal directions between a retracted, unlatched position within the hollow of the housing and an extended latched position extending out of the hollow of the housing for latching coaction with a keeper structure on an associated jamb;*

*actuator means comprising upper and lower actuators positioned in vertically spaced side-by-side relation in the housing and each pivotally mounted in the housing intermediate the upper and lower hooks, adapted to receive a tail member and operative in response to movement of the tail member to move the upper and lower hooks in unison between their unlatched and latched positions, wherein the unlatched position corresponds to a first position of the tail member and the latched position corresponds to a second position of the tail member, and wherein the actuators are ganged together by a gang link so that pivotal movement of one actuator generates corresponding pivotal movement of the other actuator;*

*a handle assembly including an escutcheon plate adapted to be mounted on the stile of the door, a handle mounted on the escutcheon plate, and a latch actuator device mounted on the escutcheon plate and including the tail member which is adapted to extend through an aperture in the stile for receipt by the actuator means, wherein the handle assembly includes upper and lower fastener members extending through upper and lower holes in the escutcheon plate, through the stile, and through the upper and lower holes in the housing sidewall; and*

*a spring mounted between the housing and at least one of the pivot arms, the spring adapted to continue pivotal movement of the at least one pivot arm toward each of the first position and the second position.*

*20. A multi-point sliding door latch and handle assembly according to claim 19 wherein the hooks open toward each other in their latched positions.*

*21. A multi-point sliding door latch and handle assembly according to claim 19 wherein the assembly further includes an upper link interconnecting the upper actuator and the upper hook and a lower link interconnecting the lower actuator and the lower hook.*

*22. A multi-point sliding door latch and handle assembly according to claim 19 wherein;*

*the upper hook is positioned in the housing above the upper housing side wall hole;*

*the lower hook is positioned in the housing below the lower housing side wall hole; and*

*the actuator means are positioned in the housing between the upper and lower housing side wall holes.*

*23. A multi-point sliding door latch adapted to be fitted in a single opening in a lock face of a stile of a door and arranged for coaction with a keeper structure on an associated jamb and for coaction with a handle assembly mounted on the stile of the door and including a tail member operated by a thumb turn or a key lock, the latch comprising:*

*a single unitary hollow housing defining a single vertically elongated hollow interior, the single housing adapted to fit in the stile opening;*

*a pair of vertically spaced upper and lower hooks each pivotally mounted in the single hollow interior of the single housing for movement in opposite pivotal directions between a retracted, unlatched position within the single hollow interior of the single housing and an extended, latched position extending out of the hollow of the single hollow interior of the single housing for latching coaction with the keeper structure; and*

*and actuator means positioned in the single hollow interior of the single housing intermediate the upper and lower hooks and including*

*a first pivot arm adapted to receive a tail member from the handle assembly and mounted on the single housing for pivotal movement about a fixed axis, and a first linkage mechanism pinned to the first pivot arm, the first linkage mechanism interconnecting the first pivot arm and the upper hook; and*

*a second pivot arm mounted on the single housing for pivotal movement in the same direction with the first pivot arm, wherein the actuator means is operative in response to turning movement of the first pivot arm in one direction about the fixed axis by the tail member to move the upper and lower hooks in unison but in opposite pivotal directions between their unlatched and latched positions.*

*24. A multi-point sliding door latch adapted to be fitted in a single opening in a lock face of a stile of a door and arranged for coaction with a keeper structure on an associated jamb and for coaction with a handle assembly mounted on the stile of the door and including a tail member operated by a thumb turn or a key lock, the latch comprising:*

*a unitary hollow housing adapted to fit in the stile opening;*

*a pair of vertically spaced upper and lower hooks each pivotally mounted in the housing for movement in opposite pivotal directions between a retracted, unlatched position within a hollow of the housing and an extended, latched position extending out of the hollow of the housing for latching coaction with the keeper structure;*

*actuator means positioned in the housing intermediate the upper and lower hooks and including a pivot arm adapted to receive a tail member from the handle assembly and mounted on the housing for pivotal movement about a fixed axis and a linkage mechanism interconnecting the pivot arm and the upper and lower hooks and operative in response to turning movement of the pivot arm in one direction about the fixed axis by the tail member to move the upper and lower hooks in unison but in opposite pivotal directions between their unlatched and latched positions; and*

*a spring for producing a bias against the actuator means, wherein the bias is translated from the spring, via the actuator means, to at least one of the upper hook and the lower hook when the at least one hook is in the latched position and when the at least one hook is in the unlatched position, wherein the spring is adapted to continue pivotal movement of the actuator means to move the least one hook toward each of the latched position and the unlatched position.*

* * * * *